US006116375A

United States Patent [19]

Lorch et al.

[11] Patent Number: 6,116,375

[45] **Date of Patent: *Sep. 12, 2000**

[54] ACOUSTIC RESONATOR

[76] Inventors: Frederick A. Lorch, 25 Voyagers La., Ashland, Mass. 01721; Gordon P. Sharp, 89 Annawan Rd., Newton, Mass. 02168; George Succi, 10 Sixtysecond St., Newburyport, Mass. 01950

[ * ] Notice: This patent issued on a continued prosecution application filed under 37 CFR 1.53(d), and is subject to the twenty year patent term provisions of 35 U.S.C. 154(a)(2).

[21] Appl. No.: 08/558,355

[22] Filed: Nov. 16, 1995

[51] Int. Cl.[7] ..... E04F 17/04

[52] U.S. Cl. ..... 181/224

[58] Field of Search ..... 181/224, 249, 181/250, 251, 255, 269, 272, 273

[56] References Cited

U.S. PATENT DOCUMENTS

| | | | |
|---|---|---|---|
| 3,033,307 | 5/1962 | Sanders et al. | 181/224 |
| 4,287,962 | 9/1981 | Ingard et al. | 181/224 |
| 4,600,619 | 7/1986 | Chee et al. . | |
| 4,645,032 | 2/1987 | Ross et al. . | |
| 5,353,598 | 10/1994 | Huck et al. . | |

FOREIGN PATENT DOCUMENTS

| | | |
|---|---|---|
| 0 505 342 A2 | 9/1992 | European Pat. Off. . |
| 0 549 402 A1 | 6/1993 | European Pat. Off. . |
| 1 853 816 | 6/1962 | Germany . |
| 234 383 | 1/1945 | Switzerland . |
| 366677 | 2/1963 | Switzerland . |
| 996030 | 6/1965 | United Kingdom . |

OTHER PUBLICATIONS

International Search Report, Apr. 4, 1997, PCT/US96/18491.

Written Opinion, Aug. 19, 1997, PCT/US96/18491.

*Primary Examiner*—Khanh Dang

*Attorney, Agent, or Firm*—Wolf, Greenfield & Sacks, P.C.

[57] ABSTRACT

A resonator as disclosed that has a plurality of resonating chambers having a predetermined size that attenuate sound in a conduit. The resonator may be disposed along the inner periphery of the conduit. Alternatively, it may be disposed on the outside periphery of the conduit so that flow through the conduit may be unrestricted. Additionally, the resonator may include a honeycomb fairing to attenuate sound at higher frequencies. Also disclosed is a system in which a resonator may be located within the conduit of an HVAC system to attenuate the sound.

54 Claims, 5 Drawing Sheets

ACOUSTIC RESONATOR

BACKGROUND OF THE INVENTION

1. Field of the Invention

This invention relates to an acoustic resonator for attenuating sound in a conduit.

2. Background of the Invention

Mechanical air control equipment for a Heating Ventilation and Air Conditioning (HVAC) system can be a major source of sound in a building. If the sound generated by the mechanical equipment is obtrusively loud its effect can have serious consequences on the overall environment in a building. Air distribution ducting in an HVAC system can act as a transmission path for the unwanted sound throughout a building. Additionally, fluid flowing through abrupt changes in the cross-sectional dimensions of a duct can also produce sound. The sound created by a mechanical device or within the ducting system can travel upstream in a return air duct and downstream in a supply air duct and thus be heard by an occupant of a room within the building. Various sound sources within the duct include, but not are limited to, circulating fans, grills, registers, diffusers, air flow regulating devices, etc. Accordingly, there has been a longstanding problem with the amount of sound which is transmitted through the ducting of an HVAC system.

Various attempts have been made to minimize the sound in air ducting. One such system, commonly referred to as a dissipative silencer, provides a sound attenuating liner either inside or outside the duct. The material may be foam, mineral wool or fiberglass insulation. These materials moderately attenuate sound over a broad range of frequencies; however, these liners are sometimes not desirable because of space requirements and the extended length of coverage required to produce adequate attenuation.

Additionally, reactive silencers have been used to attenuate sound. They typically consist of perforated metal facings that cover a plurality of tuned chambers. The outside physical appearance of reactive silencers is similar to that of dissipative silencers. Generally, reactive silencers attenuate low frequency sounds. Because broad band sound attenuation is more difficult to achieve with reactive silencers than with dissipative silencers, longer lengths may be required to achieve similar sound loss performance.

Another attempt to reduce the noise in a duct includes producing an inverse sound wave that cancels out unwanted noise at a given frequency. An input microphone typically measures the noise in a duct and converts it to an electrical signal. The signal is processed by a digital computer that generates a sound wave of equal amplitude and 180° out of phase. This secondary noise source destructively interferes with the noise and cancels a significant portion of the unwanted sound. The performance of these active duct silencers is limited by, among other things, the presence of excessive turbulence in the airflow passage. Typically, manufacturers recommend using active silencers where duct velocities are less than a 1500 feet per minute (FPM) and where the duct configurations are conductive to smooth evenly distributed airflow. These operational parameters limit the broad usage of the canceling sound technique. Additionally, the high cost of a sound cancellation system further limits its use. The present invention addresses the limitation of the prior art and provides an acoustic resonator that attenuates the sound carried in the air control system.

SUMMARY OF THE INVENTION

The present invention provides an acoustic resonator which is adapted to attenuate sound in a conduit. The resonator of the present invention includes at least one resonating chamber having walls that define a length and a height. The length of the resonating chamber is selected to provide noise attenuation of a predetermined frequency. The walls of the chamber define an opening between the elongate passage and the chamber. The opening has a predetermined size which is smaller than the length of the chamber, wherein the length of the chamber is disposed parallel to the axis of the elongate passage. Further aspects of the invention include placing the resonator within the passage. Alternatively the resonator may be mounted on conduit outside the passage. An aerodynamic fairing may be provided to reduce the amount of turbulence which is created by fluid flowing through the passage. The fairing may include a plurality of honeycomb cells that are adapted to attenuate sound in the high frequency range. Additionally, the predetermined frequency that the chamber is designed to attenuate may be related to the sum of the length of the chamber and the axial length of the opening.

In another embodiment of the invention, a ventilation system is provided that includes a duct having an opening in communication with the room and a fluid control device supported in the duct. A resonator may be provided in the duct at the upstream or downstream location with respect to the fluid control device. The resonator includes at least one resonating chamber having walls that define a length and a height. The length is selected to provide noise attenuation at a predetermined frequency. The walls of the chamber define an opening between the duct and the chamber, the opening having a predetermined size that is smaller than the length of the chamber. In another aspect of this embodiment, the length of the chamber may be disposed parallel to the axis of the duct.

Accordingly, it is an objective of the present invention to provide an acoustic resonator that attenuates the sound field located within a conduit.

It is also an object of the invention to provide a sound attenuating means for minimizing the sound within the duct work of an HVAC system.

BRIEF DESCRIPTION OF THE DRAWINGS

The foregoing and other objects of the present invention will be better understood from the detailed description with the accompanying drawings, in which.

DETAILED DESCRIPTION OF THE INVENTION

Figure 1:
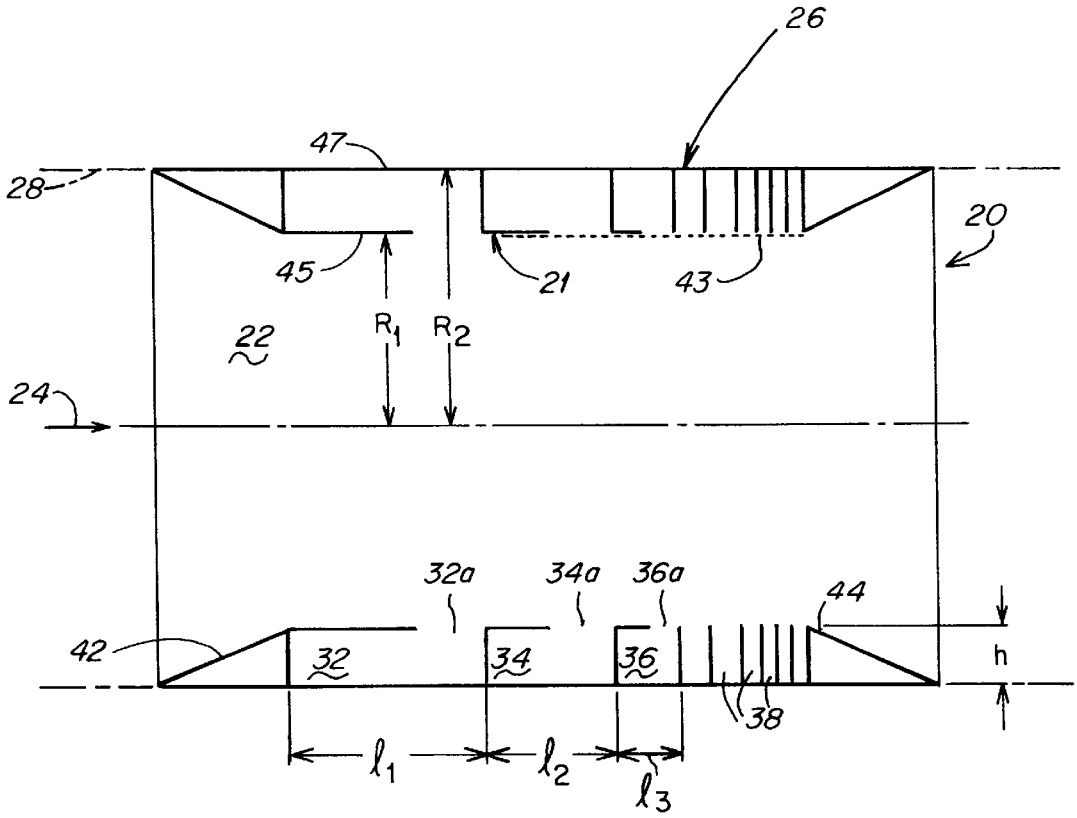
FIG. 1 is an axial cross-sectional view of a circular duct incorporating a first embodiment of the present invention and is taken along lines 1—1 in FIG. 2.
Figure 2:
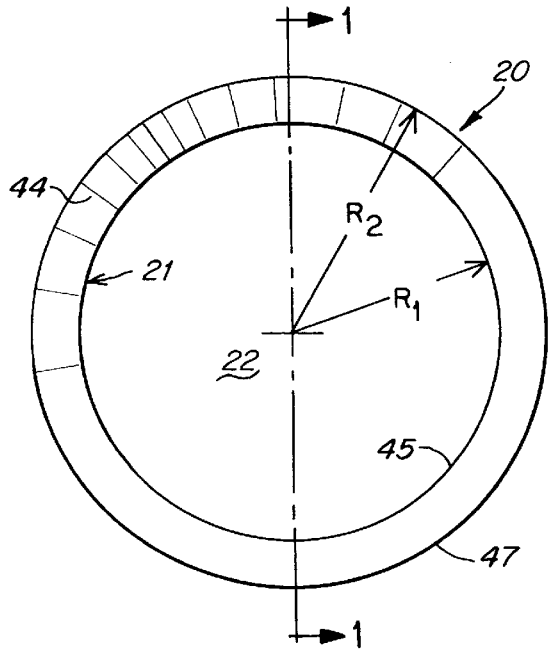
FIG. 2 is an end view of a duct incorporating the resonators as shown in FIG. 1.

A preferred embodiment of the present invention is shown with reference to FIGS. 1 and 2 in which a resonator, indicated generally at 20, has an annular passageway 22 through which air flows in a direction indicated by arrow 24. A plurality of annular resonance chambers, indicated generally at 26, are provided to attenuate sound waves. The chambers have a predetermined length, l, height, h, and sized opening into the chamber that are selected to attenuate sound at a particular frequency. The attenuator of the present invention may be attached to ducting 28, indicated by dotted lines. The conduit which incorporates the present invention may be used in a HVAC system in either the supply or exhaust ducts. Additionally, the resonators are effective at attenuating sound created by HVAC mechanical equipment or the ducting itself. Various aspects of the invention are discussed in more detail below.

Again with reference to FIGS. 1 and 2, the plurality of annular chambers are provided on the periphery of the resonator 20 to attenuate sound at a predetermined frequency. In one application, the predetermined frequencies are selected based on the sound generated by a fluid control device. The sound spectrum of a fluid control device can be empirically determined so that the resonance chambers 26 may be sized to attenuate sound at a particular frequency (ies). These are the frequencies which it may be desirable to eliminate so that the noise in a given conduit system will be attenuated. Once these frequencies are determined, the preferred size of the resonance chambers 26 can be calculated as provided below.

The wavelength of the sound traveling at that frequency can be determined by the relation:

$$f = \frac{C}{\lambda}$$

where C is the speed of sound (approximately 1100 feet per second); f frequency in Hz and λ is the wavelength. Accordingly, since C is approximately 1100 feet per second, a thousand hertz frequency will have a wavelength of approximately one foot. Given the wavelength of an undesirable sound, the preferred dimension of the resonating chamber can be calculated based on which frequency will be attenuated.

Any chamber which is sized to be out of phase with the wavelength will operate to attenuate the sound travel at that frequency. Optimally, the size of the chamber should be such that the wavelength of the sound in the chamber is 180° out of phase with the wavelength of the sound which is to be attenuated. This provides the maximum amount of noise reduction. For chamber sized either at 1 wavelength or at ½ wavelength, the sound is in phase and no noise attenuation will result. When a chamber is sized to be either ¼ wavelength or ¾ wavelength the sound becomes 180° out of phase and optimal noise reduction is provided.

In the above example of 1000 Hz, because the wavelength is approximately one foot, any chamber which has a one foot length would not operate to reduce the noise since it is the equivalent of 1 wavelength. Similarly, a chamber which is sized at six inches in this example, or ½ wavelength, also would not operate to reduce the noise because the wavelength of the sound in the chamber is not out of phase with the wavelength of the frequency of the sound. When the chamber is sized at one-quarter of a wavelength, in this example 3 inches, the wavelength in the chamber is 180° out of phase with the wavelength of the noise and thus the chamber attenuates the noise. A similar effect occurs at 9 inches because it is three-quarters of a wavelength. Accordingly, in chambers sized to be either 3 inches or 9 inches, wavelengths will each be 180° out of phase with the sound transmission and will operate to attenuate the sound at 1,000 hertz. Given the above, one skilled in the art will recognize that ¼ and ¾ wavelength resonators will function the same way. Since it is generally desirable to have a smaller, rather than larger, chamber, the present invention preferably incorporates a ¼ wavelength resonator.

Each chamber has an opening which connects the chamber to the passage, this allows the sound to enter the chamber to be reflected back into the duct. The openings may be located on the downstream end (as shown) or on the upstream end of the chambers. The walls of the chamber define openings and are selected to be any size which is smaller than ⅛ of one wavelength of the sound that the chamber is designed to attenuate.

The length l of a chamber may be oriented along the axis of the passage, reducing the profile of the resonator. Alternatively, the resonator may be disposed transverse to the axis of the passage. When the length l of the chamber is oriented along the axis of the passage the frequency which was attenuated by the chamber was found to vary with the size of the opening. Surprisingly, the length of the chamber added to the axial length of the opening provides a close approximation for the length associated with the attenuation of a given frequency. More specifically, if the length of the chamber parallel to the passage is 3 inches and there is a 1 inch opening, the frequency which is attenuated is that frequency which would conventionally be expected with a 4 inch length. This has been experimentally verified for chambers having a length as short as 1 inch.

Referring again to FIG. 1, the sound spectrum identified by testing for a particular fluid device included undesirable sound levels at frequencies centered at approximately 850 hertz and 1,200 hertz. Accordingly, using the technique described above, chamber 32, having a length l1=3 inches and an opening of 1 inch is adapted to reduce the sound at approximately 850 hertz; chamber 34 having an l2=2 inches and an opening of 1 inch was adapted to reduce the sound centered at approximately 1,000 hertz; and chamber 36 having a length l3=½ inches and an opening of ½ inch was adapted to reduce sound centered at approximately 1,200 hertz. Thus, the particular frequencies of the sound which is attenuated may be selected based on the size of the chamber (s).

Various smaller chambers indicated 38 provide sound reductions at frequencies at 2,000–4,000 Hz. These annular chambers form rings around the conduit. The frequency of the sound which is attenuated by a ring chamber is related to the width of the chamber along the axial dimension and the radial length of the chamber. Additionally, it has been found that there is a synergistic effect when a plurality of chambers are in a resonator. Empirical testing has demonstrated that frequencies are attenuated by the chambers in addition to the particular frequencies the chambers are designed to attenuate. In addition to the sound attenuated above, the invention provides sound attenuation at low frequencies. It is possible that the plurality of chambers act in concert to form a larger virtual chamber that attenuates low frequency sound. This has provided an unexpected benefit of using a plurality of chambers having different predetermined sizes.

As shown in FIGS. 1 and 2, the resonators of a representative embodiment of the invention extend into the passageway approximately 1". An aerodynamic fairing 42 is provided to reduce the turbulence of air as it flows in the passageway 22. Similarly, an aerodynamic fairing 44 at the downstream end of the resonator allows the airflow to transition to the cross-section of the conduit. Preferably, the extension of the resonator 26 into the passageway is limited such that air turbulence and flow restriction are minimized. The fairings are also adapted to minimize turbulence as fluid flows through the conduit. In the representative embodiment, fairings 42 and 44 extend 2 inches upstream and 2 inches downstream. Additionally, screening 43 may be provided along the inside diameter of the conduit 21 to further reduce the turbulence of the fluid by allowing the sound to enter the chambers and minimizing eddying in the openings.

The amount of sound attenuated by a particular chamber is related to the height h of the chamber. A 2 inch high chamber will produce a greater amount of sound reduction for a given frequency than a 1 high chamber. However, the increased height may impede fluid flow. As shown in FIGS. 1–4, the "height" of the chamber is the distance between the inner wall 45 and the outer wall 47. In the annular embodiment shown, the height h is the distance between $R_2$ and $R_1$. Accordingly, for the first embodiment, the benefits of the height of the resonator must be weighed against the amount of flow restriction created by a given height. A 2 inch high resonator provided increased attenuation of the sound; however, in the embodiment shown in FIGS. 1 and 2, the flow was restricted more than an acceptable amount.

Figure 3:
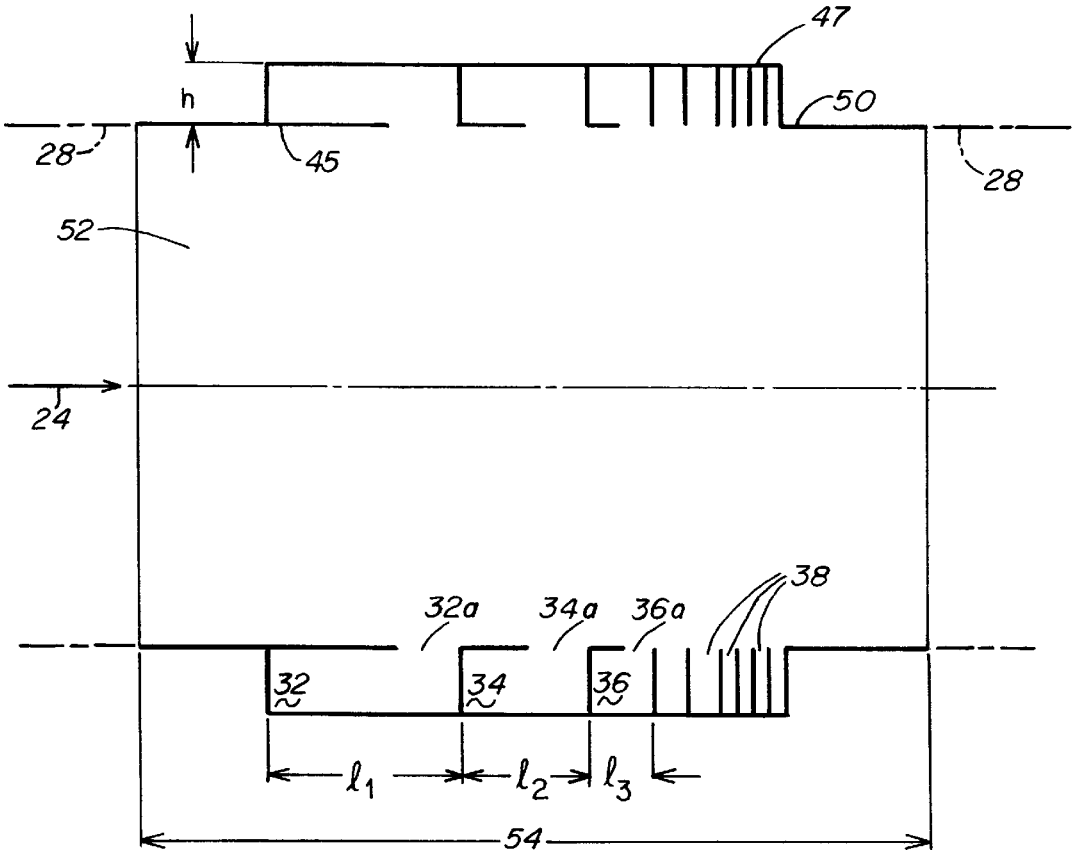
FIG. 3 is an axial cross-sectional view of a circular duct incorporating a second embodiment of the present invention and is taken along lines 3—3 in FIG. 4.
Figure 4:
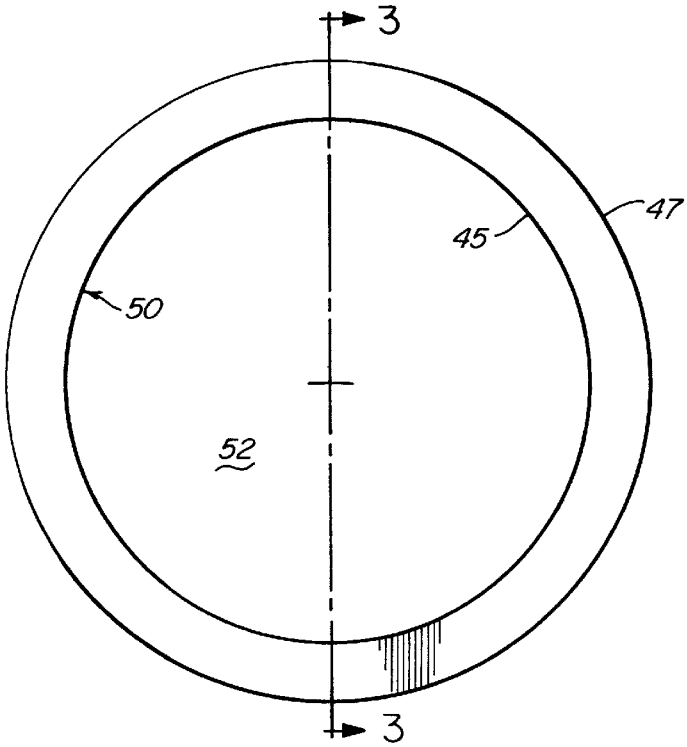
FIG. 4 is an end view of a conduit incorporating a second embodiment of the acoustic resonator.

A second embodiment of the invention, shown with references to FIGS. 3 and 4, provides an attenuator creating no flow restriction along the duct. In these FIGS. the resonator is disposed on the outer periphery of an annular duct 50. The duct defines a passageway 52 that maintains a constant cross-section throughout its axial length 54. Thus, there is no restriction in the flow and the benefits of the resonator can be fully realized while not incurring a fluid pressure drop across the resonator. Additionally, the height of the resonator does not impede the fluid flow so essentially any convenient height may be used. Of course, a resonating chamber which extends partially into the flow path and partially outside the flow path is also possible and contemplated by this invention.

Figure 5:
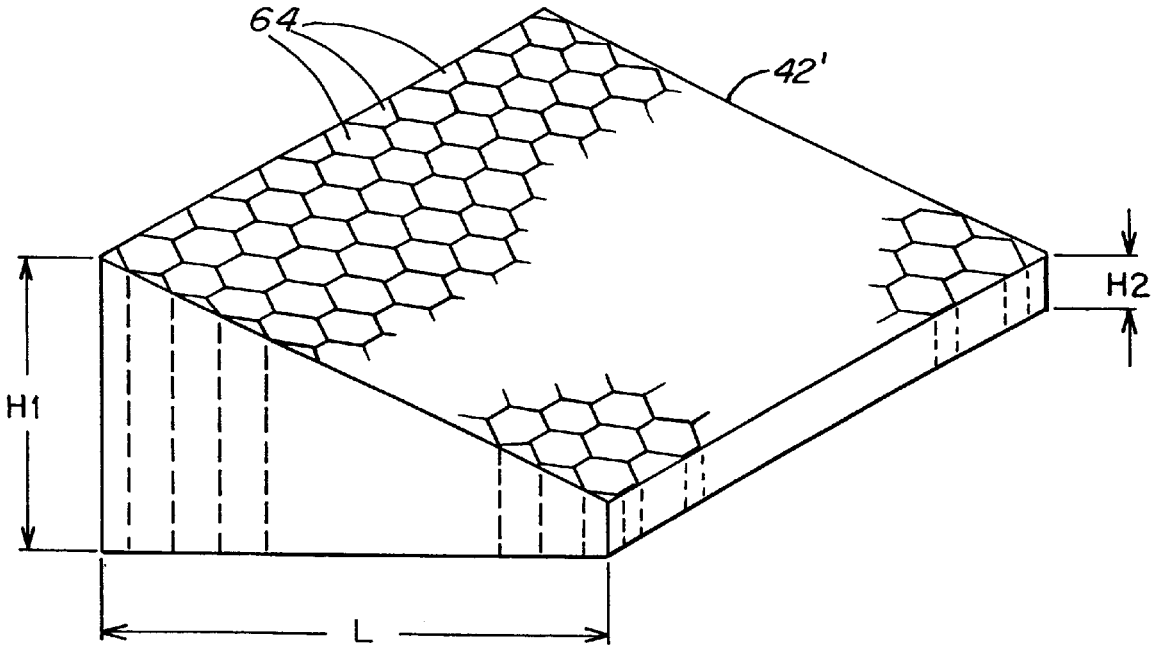
FIG. 5 shows a detail view of an aerodynamic fairing that incorporates a honeycomb pattern to attenuate high frequency noise.
Figure 6:
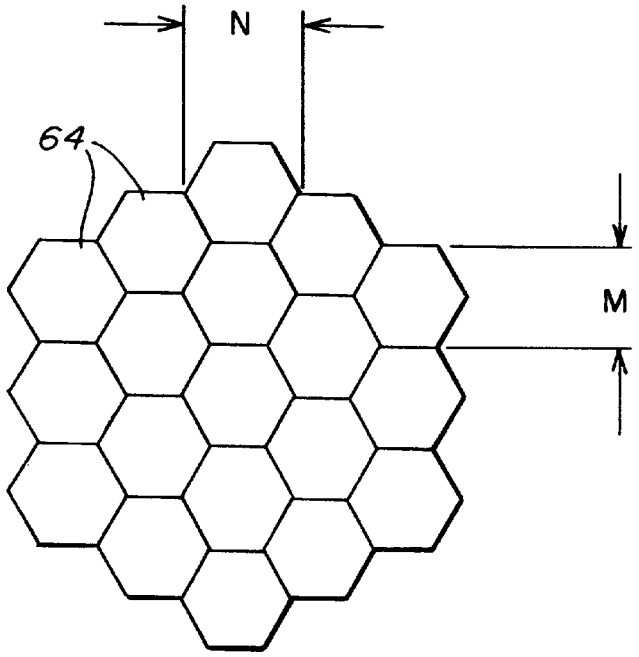
FIG. 6 is a detail top view of the honeycomb.

With reference to FIGS. 5 and 6, the aerodynamic fairings for the acoustic resonator may be provided with honeycomb shaped chambers extending therethrough so that various high frequency sounds may be attenuated. Fairing 42' has a height H1 which may be placed adjacent to the resonating chambers. The fairings extend a distance L away from the resonating chambers. This can be used as a ramp to achieve noise reduction while minimizing pressure reduction across the resonator. The honeycomb chambers 64 extend vertically throughout fairing 42' as illustrated by dotted lines. The fairing 42' is given a sloped upper surface which varies in height from H1 to H2. The honeycomb chambers function in much the same way as the radially extending chambers 38 in that the sound is able to enter into a chamber through an open side and the sound bounces from the bottom surface. A screen may be disposed on the ramped surface. Therefore, the height of the fairing 42' at any given point determines what frequency is attenuated. As shown in FIG. 6, which illustrates a detailed view of the honeycomb structure, each honeycomb is provided a certain length N and a width M. Preferably, for the present application of the invention N=½ inches and M=½ inches. The honeycombs are shown as hexagons, which are preferable because of the efficient space utilization of the pattern. One skilled in the art will appreciate that chambers of appropriate size may be distributed throughout the honeycomb. Various other polygonal shapes might be used such as squares or octagons. Alternatively, the honeycomb chambers may have a circular cross section. Because the fairing 42' varies in height from H1 to H2, a range of frequencies are attenuated. At the particular heights from H2 equals ½ inch to H1 equals 1 inch, sound in the range of 4 to 10 kHz range is attenuated. Of course the honeycomb fairing may be placed on either the upstream or the downstream side of the resonator.

Figure 7:
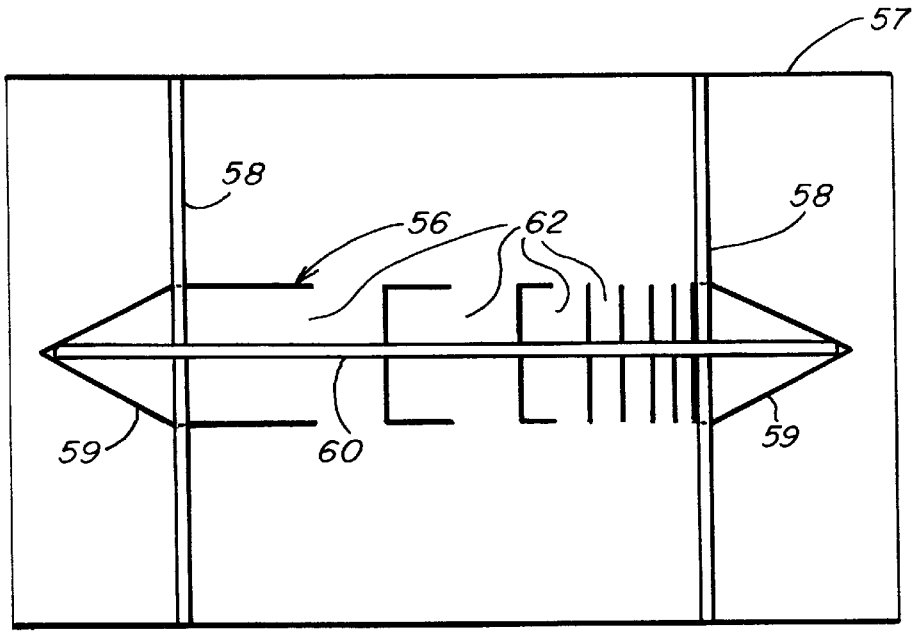
FIG. 7 is an axial cross-sectional view of a third embodiment of the invention disposed in a cylindrical duct and taken along section lines 7—7 of FIG. 8.
Figure 8:
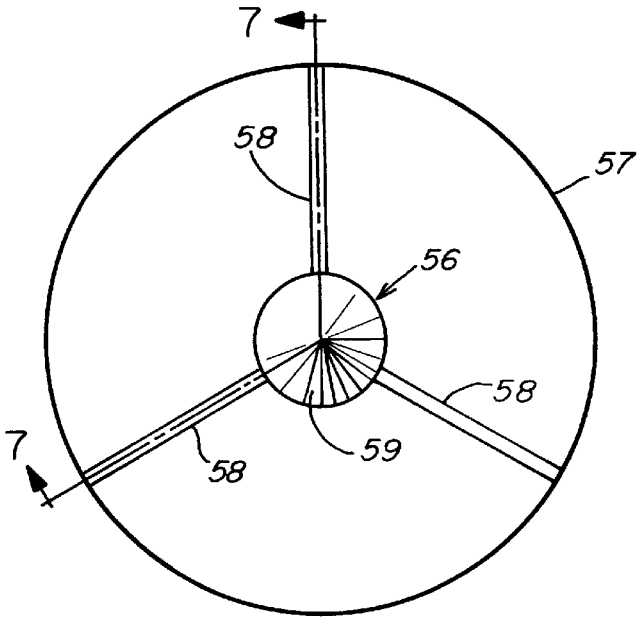
FIG. 8 is an axial cross-sectional view of the conduit incorporating a third embodiment of the invention.

With reference to FIGS. 7 and 8, another embodiment of the invention is described in which a resonator 56 is centrally located within a conduit 57 and supported by an arm(s) 58 which extends from the sides of the conduit. The arm(s) should be designed to minimize flow restriction in the passage. The central resonator has a circular cross-section, fairings 59 and a central support member(s) 60. The sizes of chambers 62 are determined using the analysis as the previous embodiment. Empirical testing has indicated that at times the sound within a given duct appears to collapse into the central portion of the duct. One situation where this is believed to occur is immediately downstream of a venturi-type valve that supplies a room with air as described below. When the noise is collapsed into the central portion of a conduit, the resonators which are disposed on the periphery may not be as effective at reducing the noise in the duct. Accordingly, disposing a resonator in the central portion of the duct may be more effective for attenuating sound in the system.

Figure 9:
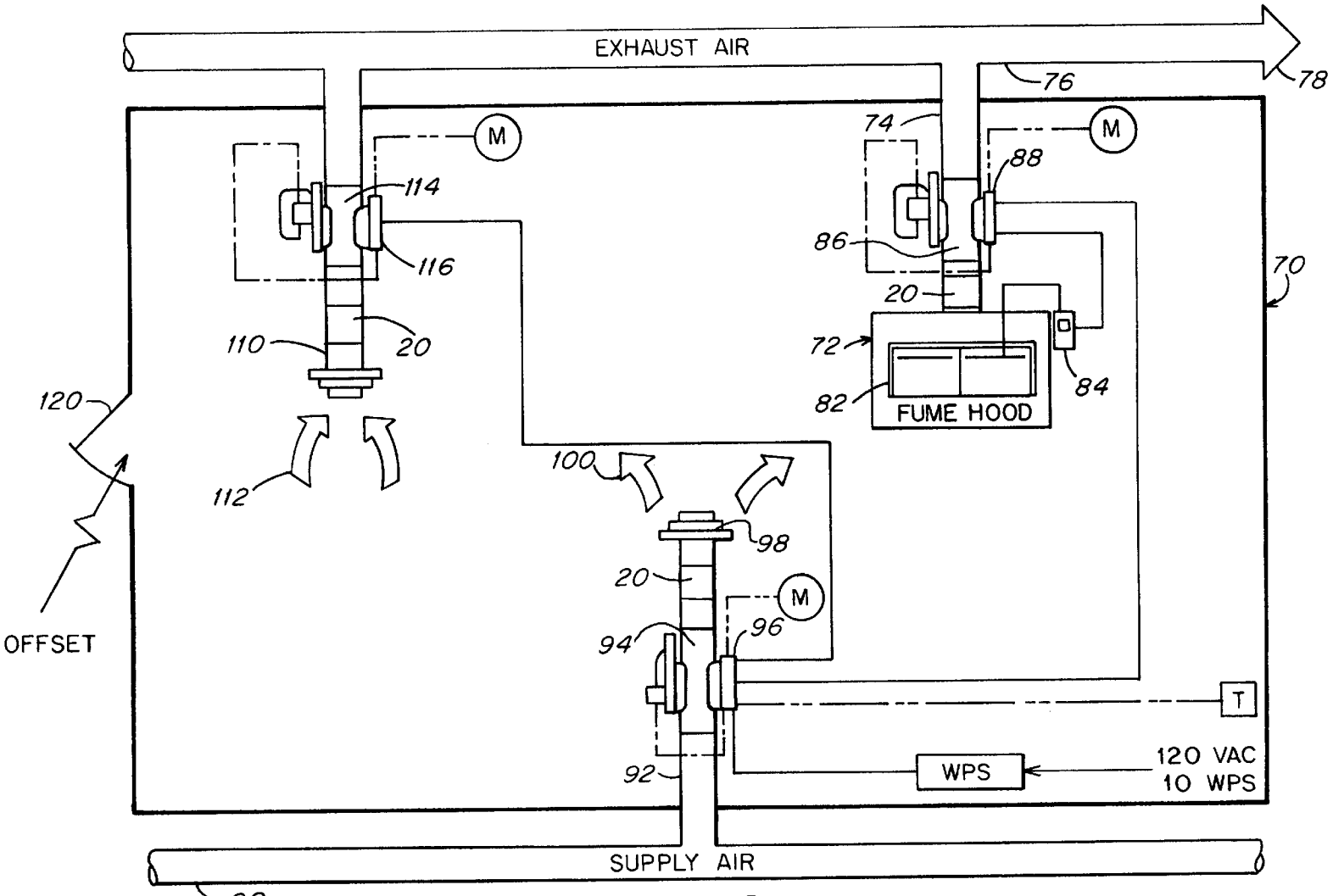
FIG. 9 shows a system incorporating the acoustic resonator of the present invention.

FIG. 9 shows a schematic representation of an application for the resonator according to the present invention in an air control system for a laboratory, generally indicated by 70. Typically, laboratories have specialized ventilation requirements which are more complex than many standard air control applications. One reason for the increased complexity is a fume hood 72 which is generally considered necessary for safe laboratory operation. The fume hood must be carefully controlled at all times to maintain a constant average face velocity (the velocity of air as it passes through the sash opening) that compiles with OSHA and other industry standards. The fume hood has an air conduit 74 which leads to an exhaust air conduit 76 that discharges the air from the system as indicated by an arrow 78. A blower (not shown) operates to draw air through the exhaust air conduit. The constant average face velocity of air desired at fume hood sash 82 is maintained by a sash sensor module 84 which monitors the amount the sash is opened. When the sash is opened, the larger open area requires a greater volume of air to maintain the acceptable face velocity. Accordingly, a signal is sent to a fume hood exhaust valve 86, which is adjusted by a controller 88, so that a greater volume of air is permitted to flow through the valve, and thus increase the amount of air which is drawn through the sash opening.

With the increased volume of air flowing through the conduit 74, a supply of air must be provided to "make up" the fluid drawn through the exhaust conduit. A supply conduit 90 provides air to a room supply conduit 92. A flow control valve 94 disposed in the conduit controls the volume flow rate of fluid which is permitted to flow into the room. When the sash is raised, the exhaust valve controller 88 send a signal to controller 96 to the supply flow control valve to "make up" for the air which is exhausted. The supply air enters the room through the grill 98 as indicated by arrows 100. The supply valve may be designed to respond to temperature and humidity requirements, for example, a sensor T may indicate that more supply air is required.

Typically, the number of people, operating equipment and lighting as well as other factors cause sensor T to indicate more supply air is desired.

A general exhaust duct 110 is provided to remove air, indicated by arrows 112, from the laboratory when the air is being supplied into the room. An exhaust valve 114 is controlled by a controller 116 that responds to a signal sent from the supply controller 96. Typically, each supply and exhaust valve is operated in a dynamic control system. The laboratory may be maintained at a negative pressure so that the air flow is always into the laboratory, even when a door 120 is in an opened position (as shown).

The resonator 20 of the present invention may be provided in the exhaust conduit upstream from the exhaust valve for effective noise reduction. In this position the resonator attenuates the sound from the exhaust valve as it travels toward the room. Thus, in an exhaust conduit, the direction of the flow of air and the direction of the flow of sound are opposite and the resonator can be placed at any point along the ducting between the noise source and the room which is to be ventilated. A plurality of resonators may be used to increase the sound attenuating effect. Additionally, and advantageously, the resonator may be disposed in the conduit on both sides of the control device.

The resonator 20 according to the present invention may also be incorporated in the supply conduit 92, downstream from the noise source. In a supply conduit the air and the sound are traveling in the same direction and it has been empirically determined that the resonator should be placed approximately three to five equivalent duct diameters away from the noise source for optimum performance. That is, if the duct diameter is 10 inches, the resonator should be placed approximately 30 to 50 inches away from the noise source. One possible explanation for this is that the sound in a supply valve collapses on itself because it is traveling in the same direction as the air and it takes roughly the equivalent of three to five duct diameters for the sound to expand into the full cross-section of the conduit. In a supply conduit, the fourth embodiment, illustrated in FIG. 7, may provide an adequate amount of noise reduction at any distance from the source because the resonator is centrally located within the conduit.

The resonator may be constructed for insertion within the inner diameter of the conduit. The outer wall may be formed as a part of the resonator or, alternatively, the wall of the duct may form the outer wall of the resonator. The resonator may also be constructed so that it can form part of a ventilation conduit and be retrofitted into an existing conduit. In another configuration, the resonator may be formed so that it can be installed on the outer surface of the duct. Alternatively, the resonator may be as a conduit and installed between the sections of ducting.

Accordingly, the present invention provides a resonator that has at least one chamber having a predetermined size that attenuates sound at a selected frequency. The resonator may be disposed along the inner periphery of a fluid flow conduit. Alternatively, the resonator may be disposed outside the periphery of the conduit so that the flow of fluid through the conduit is not restricted. Additionally, the resonator may include a honeycomb fairing to attenuate sound at higher frequencies. Finally, the resonator may be located within a conduit of an HVAC system to attenuate sound.

While there have been shown and described what are considered to be the preferred embodiment of the present invention, it will be obvious to those skilled in the art that various changes and modifications made therein without departing from the scope of the invention as defined in the appended claims. Thus, the height of the resonator may be extended by positioning the resonator chambers partially inside and partially outside the duct. It should be understood that a resonator according to the present invention may have a rectangular shape and disposed in a rectangular duct and disposed on up to all four sides of the duct. Additionally, the resonators may be placed in series along a duct for improved noise attenuation.

What is claimed is:

1. A system for the ventilation of a space comprising:

a ventilation conduit having a longitudinal axis;

a ventilation fluid control device disposed in said conduit; and a resonator disposed in fluid communication with said fluid control device, said resonator including a resonating chamber having a predetermined longitudinal length substantially parallel to the longitudinal axis that corresponds to a function of a wavelength of sound at a first frequency, above 200 Hertz, generated by said fluid control device, that is primarily attenuated by said resonating chamber, and a height, wherein the first frequency will remain the frequency of primary attenuation regardless of said height of said at least one resonating chamber.

2. The ventilation system of claim 1, wherein the first frequency is above about 850 Hertz.

3. The ventilation system of claim 2, wherein the first frequency is above about 1,200 Hertz.

4. The ventilation system of claim 2, wherein the first frequency is above about 2,000 Hertz.

5. The ventilation system of claim 2, wherein the resonator comprises a multiplicity of resonating chambers, each having a predetermined size that is selected to attenuate sound at a predetermined frequency.

6. The ventilation system of claim 2, wherein the resonating chamber has an opening having an opening length, the longitudinal length and the opening length being selected so that the sum of the opening length and the longitudinal length are a predetermined function of the first frequency.

7. The ventilation system of claim 6, wherein the sum of the longitudinal length and the opening length of the resonating chamber is about one-quarter of a wavelength for the first frequency.

8. The ventilation system of claim 2, wherein said resonator is disposed in said conduit between said fluid control device and the space.

9. The ventilation system of claim 2, wherein said fluid control device has a first side and a second side and wherein said resonator is disposed in said duct of said first side of said fluid control device and further comprising a second resonator disposed on said conduit at said second side of said resonator.

10. The ventilation system of claim 1, wherein the first frequency is above about 850 Hertz.

11. A resonator for a ventilation system, the ventilation system including a ventilation conduit having a longitudinal axis and a fluid control device disposed in the conduit, the resonator comprising:

a body constructed and adapted for mounting to the ventilation conduit; and at least two resonating chambers, each of said at least two resonating chambers having a predetermined longitudinal length substantially parallel to the longitudinal axis that corresponds to a function of a wavelength of sound at a predetermined frequency above 200 Hertz, that is primarily attenuated by said resonating chamber, and a height, wherein the predetermined frequency of each of said at least two resonating chambers will remain the frequency of primary attenuation regardless of said height of each of said at least two resonating chambers.

12. The resonator of claim 11, wherein the predetermined frequency for a plurality of the chambers is the same.

13. The resonator of claim 11, wherein a plurality of the resonating chambers have a longitudinal length and an opening having an opening length, and the longitudinal length and the opening length of each of said plurality of the resonating chambers are selected based on the predetermined frequency for that resonating chamber.

14. The resonator of claim 13, wherein the longitudinal length of each of the plurality of chambers is parallel to the axis of the conduit when the resonator is disposed in fluid communication with the conduit.

15. The resonator of claim 11, wherein:

a plurality of the multiplicity of resonating chambers have a longitudinal length and an opening having an opening length; and the opening length of each of said plurality of resonating chambers is no more than half of the longitudinal length of that resonating chamber.

16. The resonator of claim 15, wherein the longitudinal length and opening length of each of said plurality of resonating chambers are selected so that the sum of the opening length and the longitudinal length are a predetermined function of the predetermined frequency for that resonating chamber.

17. The resonator of claim 15, wherein the sum of the longitudinal length and the opening length of each of said plurality of resonating chambers is about one-quarter of a wavelength of the predetermined frequency for that resonating chamber.

18. The resonator of claim 11, wherein the opening of a plurality of the multiplicity of resonating chambers spans substantially all of a perimeter of the conduit when the resonator is disposed in fluid communication with the conduit.

19. The resonator of claim 11, disposed within the conduit.

20. The resonator of claim 11, disposed outside the conduit.

21. A resonator for a ventilation system, the ventilation system including a conduit having a longitudinal axis and a ventilation fluid control device disposed in the conduit, the resonator comprising:

a body constructed and adapted for mounting to the ventilation conduit; and a resonating chamber having a predetermined size that is selected to primarily attenuate sound at a first frequency generated by the ventilation fluid control device; and wherein said resonating chamber has a longitudinal length and an opening defined by an opening length, and said longitudinal length and said opening length being a predetermined function of the first frequency so that sound at the first frequency is reflected back, after traveling the length of said chamber, about 180 degrees out of phase to attenuate sound at the first frequency.

22. The resonator of claim 21, wherein the sum of the longitudinal length and the opening length is about one-quarter of a wavelength of the first frequency.

23. The ventilation system of claim 21, wherein the first frequency is above about 850 Hertz.

24. The ventilation system of claim 21, wherein the first frequency is above about 1,200 Hertz.

25. The ventilation system of claim 21, wherein the first frequency is above about 2,000 Hertz.

26. The ventilation system of claim 21, wherein the longitudinal length of the resonating chamber is parallel to the axis of the conduit when the resonator is disposed in fluid communication with the conduit.

27. A system for the ventilation of a space comprising:

a ventilation conduit having a longitudinal axis;

a ventilation fluid control device disposed in said conduit; and a resonator disposed in fluid communication with said fluid control device, said resonator including a resonating chamber having a front end wall and a rear end wall spaced therefrom a predetermined length that is selected to correspond to a function of a wavelength of sound at a first frequency, above 200 Hertz, generated by said fluid control device, that is primarily attenuated by said resonating chamber, said resonating chamber including a first side wall between said front end wall and said rear end wall, said side wall having only a single substantially continuous opening.

28. A system for the ventilation of a space comprising:

a ventilation conduit having a longitudinal axis;

a ventilation fluid control device disposed in said conduit; and a resonator disposed in fluid communication with said fluid control device, said resonator including at least two resonating chambers, each of said at least two resonating chambers having a front end wall, a rear end wall, and a side wall, said front end wall and said rear end wall defining a predetermined length that corresponds to a function of a wavelength of a sound at a predetermined frequency generated by said fluid control device that is primarily attenuated by said resonating chamber, said side wall in each of said at least two resonating chambers including a front portion and a rear portion and having only a single substantially continuous opening at the same of either said front and said rear portions thereof.

29. A resonator for a ventilation system, the ventilation system including a conduit having a longitudinal axis and a perimeter, and a ventilation fluid control device disposed in the conduit, the resonator comprising:

at least one resonating chamber, having a predetermined longitudinal length substantially parallel to the longitudinal axis that corresponds to a function of a wavelength of sound at a predetermined frequency that is primarily attenuated by said at least one resonating chamber, said at least one resonating chamber extending about the perimeter of the conduit.

30. The resonator of claim 29 wherein said resonator comprises a multiplicity of resonating chambers.

31. The resonator of claim 29 wherein the predetermined frequency is greater than 200 Hertz.

32. A resonator for a ventilation conduit comprising:

a resonator body constructed and arranged for mounting to the ventilation conduit, said resonator body including at least one resonating chamber having a predetermined length, defined by a first end wall and a second end wall, that corresponds to a function of a wavelength of a sound at a predetermined first frequency that travels the length of said chamber and is reflected off of either of said first or second end walls about 180 degrees out of phase, so that the sound wave at the predetermined first frequency is primarily attenuated by said at least one resonating chamber, the predetermined first frequency being greater than 200 Hertz.

33. The resonator of claim 32, wherein said resonator body comprises a multiplicity of resonating chambers, each having a predetermined length that is selected to attenuate sound at a predetermined frequency greater than 200 Hertz.

34. The resonator of claim 32, further including a central flow passage having a perimeter, wherein said at least one resonating chamber extends about said perimeter and is in communication with said central flow passage.

35. The resonator of claim 32, wherein the first frequency is above about 850 Hertz.

36. The resonator of claim 32, wherein the first frequency is above about 1,200 Hertz.

37. The resonator of claim 32, wherein the first frequency is above about 2,000 Hertz.

38. The resonator of claim 32, wherein the at least one resonating chamber has an annular shape.

39. A resonator for a ventilation system, the ventilation system including a ventilation conduit having a longitudinal axis and a fluid control device disposed in the conduit, said resonator comprising:

at least one resonating chamber having a first end wall and a second end wall, and a first side wall and a second side wall, wherein said first side wall includes an opening having a length, and wherein a distance between said first end wall and said second end wall defines a length of said chamber, wherein the sum of the length of the opening and of the length of the chamber is a function of a wavelength of sound that is primarily attenuated by the at least one resonating chamber.

40. The resonator of claim 39, wherein the resonator comprises a multiplicity of resonating chambers, each having a different sum of a predetermined opening length and chamber length.

41. The resonator of claim 39 further including a central flow passage having a perimeter, wherein said at least one resonating chamber extends about said perimeter and is in communication with said central flow passage.

42. The resonator of claim 39 wherein the sum of the longitudinal length and the chamber length is about one-quarter of a wavelength of the first frequency.

43. The resonator of claim 39 wherein the first frequency is above about 850 Hertz.

44. The resonator of claim 39, wherein the first frequency is above about 1,200 Hertz.

45. The resonator of claim 39, wherein the first frequency is above about 2,000 Hertz.

46. The resonator of claim 39, wherein said at least one resonating chamber has an annular shape.

47. A resonator for a ventilation system, the ventilation system including a ventilation conduit having a longitudinal axis and a fluid control device disposed in the conduit, the resonator comprising:

a resonating chamber defining a flow passage therethrough and having a first end wall and a second end wall, wherein a distance between said first end wall and said second end wall defines a length of said chamber that corresponds to a function of a wavelength of sound of a predetermined frequency greater than 200 Hertz that is primarily attenuated by said resonating chamber, said resonating chamber including a first side wall and a second side wall, said first side wall having only a single continuous opening defined by an opening length, wherein said first side wall other than at said single continuous opening is constructed and arranged to contain said sound wave at said predetermined frequency in said resonating chamber as it travels along the length thereof.

48. The resonator of claim 47 comprising a multiplicity of resonating chambers, each having a different chamber length.

49. The resonator of claim 47 further including a central flow passage having a perimeter, wherein said at least one resonating chamber extends about the perimeter and is in communication with said central flow passage.

50. The resonator of claim 47 wherein a sum of a length of said chamber and of the opening length is about one-quarter of a wavelength of the first frequency.

51. The resonator of claim 47, wherein the first frequency is above about 850 Hertz.

52. The resonator of claim 47, wherein the first frequency is above about 1,200 Hertz.

53. The resonator of claim 47, wherein the first frequency is above about 2,000 Hertz.

54. The resonator of claim 47, wherein the resonating chamber includes an annular shape.

* * * * *